US006874659B2

(12) United States Patent
Schiestl et al.

(10) Patent No.: US 6,874,659 B2
(45) Date of Patent: Apr. 5, 2005

(54) PRESSURE CONTAINER

(75) Inventors: Ulrich Schiestl, Feldkirch (AT); Hans Gschwend, Buchs (CH); Iwan Wolf, Chur (CH); Andreas Klima, Bludesch (AT); Thomas Granacher, Schaan (LI); Walter Odoni, Planken (LI); Ulrich Rosenbaum, Wangs (CH)

(73) Assignee: Hilti Aktiengesellschaft, Schaan (LI)

( * ) Notice: Subject to any disclaimer, the term of this patent is extended or adjusted under 35 U.S.C. 154(b) by 32 days.

(21) Appl. No.: 10/442,042

(22) Filed: May 20, 2003

(65) Prior Publication Data

US 2003/0218027 A1 Nov. 27, 2003

(30) Foreign Application Priority Data

May 23, 2002 (DE) ..... 102 22 749

(51) Int. Cl.[7] ..... B65D 83/62

(52) U.S. Cl. ..... 222/94; 222/95; 222/105; 222/183; 222/386.5; 222/402.13

(58) Field of Search ..... 222/402.1, 402.13, 222/402.2, 386.5, 105, 183, 94, 95, 394, 397, 399

(56) References Cited

U.S. PATENT DOCUMENTS 3,896,970 A * 7/1975 Laauwe ..... 222/94
6,073,804 A * 6/2000 Yquel ..... 222/95

* cited by examiner

*Primary Examiner*—J. Casimer Jacyna
(74) *Attorney, Agent, or Firm*—Sidley Austin Brown & Wood, LLP

(57) ABSTRACT

A pressure container with an outer container (20) and a constantly deformable or compressible inner container is arranged within the outer container (20), whose container wall is constructed of a metallic foil. A fill material chamber (11) for fill material (12) is arranged in the inner container (10) and in the outer container (20), a propellant chamber (21) is formed for propellant (22, 23), which are separated from one another in a fluid- and/or gas-tight manner. The pressure container is furthermore provided with a cover part (25) for sealing the containers (10, 20), on which a valve part (30) is arranged for dispensing fill material (12) from the fill material chamber (11) to the outside. For improving the pressure container it is proposed that a compensation body (41) be provided in the inner container (10) for the purpose of compensating volume variations in the fill material chamber (11).

5 Claims, 3 Drawing Sheets

24
26
31
27
30
25
10
11
12
20
(61)
42
40
41
23
21
22

PRESSURE CONTAINER

BACKGROUND OF THE INVENTION

The present patent application relates to a pressure container of the type having an outer container enclosing a deformable inner container formed of a metal foil. The inner container forms a chamber for a fill material. The outer container forms a chamber for a propellant. The outer container has a closure part for dispensing the fuel or fill material. Such containers are used in fuel-operated setting tools, wherein they contain the fuel.

Liquid hydrocarbons used as the fuel in the setting tools are stored in pressure vessels. The interchangeable pressure containers or fuel canisters are formed with a dispensing or dosing head attached to the fuel canister by means of a snap-on connection. The pressure container/fuel canister and dispensing head are introduced onto the setting tool. The purpose of the system is to continuously maintain the fuel in the liquid phase for dispensing through the dispensing head. Similar arrangements are made also in other applications of the pressure container, since the release of fuel in the liquid phase is always desirable in the case of devices with liquid fuel dispensing.

There are two conventional systems in the case of pressure containers:

- A plastic bag system, in which the liquid fuel is stored in a bag in the container. The bag is comprised of a flexible plastic-aluminum bonded foil and is compressed by the pressure of a gas contained in the outer container such that the inner contents are constantly in a compressed state and remains in the liquid phase. The connection of the bag with the discharge valve is made by a plastic connector, at which diffusion can occur resulting in a mixing of the inner and the outer propellant gas, whereby a failure of the canister can result.
- A metal bag system, in which an inner, thin-walled metal container, in particular made of aluminum, is disposed in an outer, thick-walled container (also made of aluminum). At the opening of the pressure container the two containers are rolled up on another, whereby the opening is sealed with a cover piece, in which a valve is arranged, Such a pressure container, for example as disclosed in U.S. Pat. No. 5,069,690, is the basis of the present invention.

Despite the inherent advantageous tightness of this metal bag system pressure container at the connecting seam of the outer container and the inner container according to U.S. Pat. No. 5,069,590, tightness problems can, however, develop as the result of temperature variations. The metallic inner container is filled with liquid phase fuel in a ready-to-use state of the pressure container, while in the outer container the outer gas is present in part in a liquid phase and in part in a gas phase. When in storage, the pressure container is generally subjected to temperature variations. The liquid phase of the inner container expands at higher temperatures and contracts at lower temperatures. The temperature variations thus result in corresponding variations of the bag volume such that the inner container expands with the expansion of the liquid fuel and again deforms inwardly with contraction of the liquid fuel. Because of these undesirable deformation conditions, local creasing or crumpling spots occur on the metallic inner bag, such spots becoming more and more rigid or imbedded due to cold forming. Consequently, this behavior results in the formation of a hole at the crumpled or crease spot of the inner bag and the pressure container or the canister fails due to leakage.

SUMMARY OF THE INVENTION

Therefore, the object of the present invention is to develop a pressure container of the above type, which eliminates the known drawbacks. This object is achieved, according to the invention, by providing a compensation body in the inner container, to which the following particular significance is attributed.

The special features of the present invention reside in the fact that a compensation body, for example, a compensation chamber, is formed of a metallic foil in the inner container surrounding a metal foil, which, for example, is separated from the fill-material chamber by means of a flexible foil or bonded foil and is sealed medium tight against the fuel. The compensation chamber is filled with a pressurized compressed material or mixture of materials, for example, air or a soft foam whose porous space is filled with air or another gas. The compensation body can, however, be configured as a pure, compressed foam body. If the volume of the fill material and consequently the fill chamber increases as a result of an increase in temperature, then the compensation chamber or the compensation body is compressed and reduced in volume in almost corresponding dimensions. As a result of this measure, the metal foil of the inner container is thus not subjected to such high mechanical stressing by temperature changes and continues to remain stable and tight even with longer storage periods of greater than 18 months.

Advantageously, if the compensation chamber is freely moveable; in other words, in the form of a pillow made of laminated film or foil, and arranged in the inner container, the configuration of the compensation chamber according to the invention as a freely moveable pillow has the advantage that a pressure container or canister provided with such a pillow is simple and economical to produce. The cushion can be introduced into the inner container prior to sealing the pressure container, whereby the cushion or the compensation chamber is previously filled with the compressible medium. After filling of the inner container with fill material, the compressed medium, for example air, can then be compressed to a fraction of its original volume. A freely moveable compensation body made out of a foam, for example, could similarly be provided.

Simultaneously, the compensation chamber or the compensation body could be arranged around the fill material chamber so that the compensation chamber or compensation body is separated outwardly via the metal bag or the metal foil of the propellant chamber and shielded in a medium tight fashion. For realization of this embodiment only a plastic bag, in particular made of a composite or laminated foil or another expandable/compressible material, needs to be introduced into the metal bag, which forms the fill material chamber. In this instance, again, the advantage resides in the favorable manufacture of the canister or the pressure container according to the invention.

It can be advantageous if the compensation chamber is filled with air, since such medium does not incur any additional manufacturing costs.

BRIEF DESCRIPTION OF THE DRAWINGS

The invention is represented in two embodiments in the drawings, wherein.

DETAILED DESCRIPTION OF THE INVENTION

Figure 1:
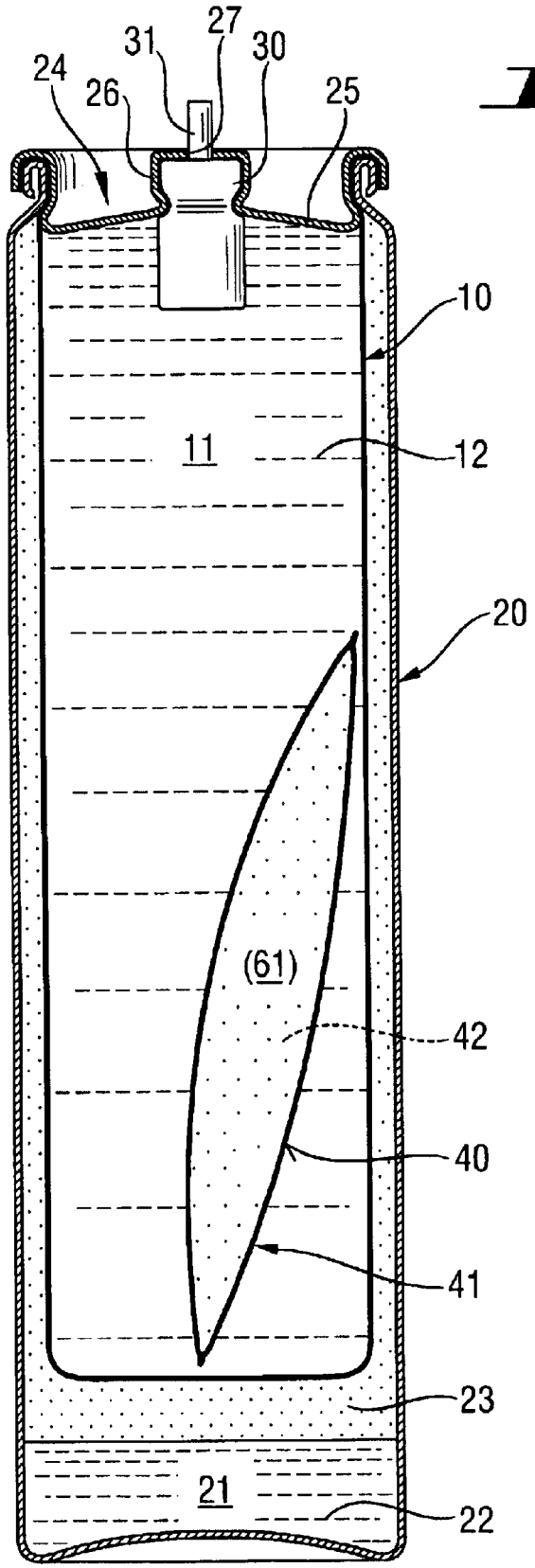
FIG. 1 diagrammatically represents a longitudinal section of a first embodiment of a pressure container according to the invention.

FIG. 1 shows a pressure container according to the invention, formed of an outer container 20 and an inner container 10. The outer container 20 in this embodiment is made of a relatively thick-walled metallic material, for example aluminum, while the inner container 10 is made of a relatively thin-walled, deformable and/or collapsible metallic material, such as thin-walled aluminum, for example. In the area of the upper opening 24, both containers 10, 20 are connected with each other and mutually sealed by rolling. The opening 24 is sealed tight against the pressure container contents leaking to the external environment. The inner container 10 encloses a fill material chamber 11 in which a dispensable fill material 12, for example, a combustible liquid fuel, is contained. Such fill material 12 or liquid fuel is under the pressure of a propellant material 22, 23 contained in the propellant chamber 21 of the outer container. The propellant is in a liquid phase 22 and in a gas phase 23 in the propellant chamber 21. A valve part 30 is arranged in a dome 26 in the opening 24 equipped with a passage 27 of a cover part 25, the valve being sealed against the cover part 25. A valve part 30 has an inlet/outlet part 31, which extends through the passage 27 and through which fill material 12 or liquid fuel can move out of the pressure container or into a further system connected to the outlet part 31 or into a dispensing head, a dosing system, and the like A compensation body 41, configured as a compensation container, is arranged freely moveable in the inner container 10 and surrounds a compensation chamber 61, which is filled with air 42 in the first embodiment. For filling, however, another compressed medium can also be used. The composite or laminated foil is, for example, constructed of a PE (polyethylene) layer and an aluminum layer (aluminum foil). However, other plastic foils and/or other metals or metal foils can also be used, such as tin, for example, or a similarly soft metal. The wall thickness of the composite or laminated foil can be 0.2 mm, for example. The compensation chamber 61 has the following function: if there is a temperature rise in the pressure container or the pressure canister, the fill material 12 present in the liquid phase expands linearly on the basis of its reduction in density. The air volume in the compensation chamber 61 or in the compensation body 40 behaves in accordance with the gas equation for ideal gases, as follows:

$$V_{compensation\ chamber}=nRT/p_{pressure\ container}(T)$$

wherein, $V_{compensation\ chamber}$=the volume of the compensation chamber, n=the number of moles, R=the gas constant, T=the temperature and $p_{pressure\ container}(T)$=the pressure in the pressure container as a factor of T and where $p_{pressure\ container}(T)$ increases more greatly than T. That is, the volume of the compensation chamber 61 diminishes with increasing temperature. If the volume variations of the liquid fill material 12 and the compensation medium 42 in the compensation chamber 61 are added, a volume variation in the inner container 10 results that is smaller by multiples than in the case of a pressure container without a compensation chamber 61 according to the invention. Relevant experimental data are reproduced in the diagram in FIG. 3.

Figure 2:
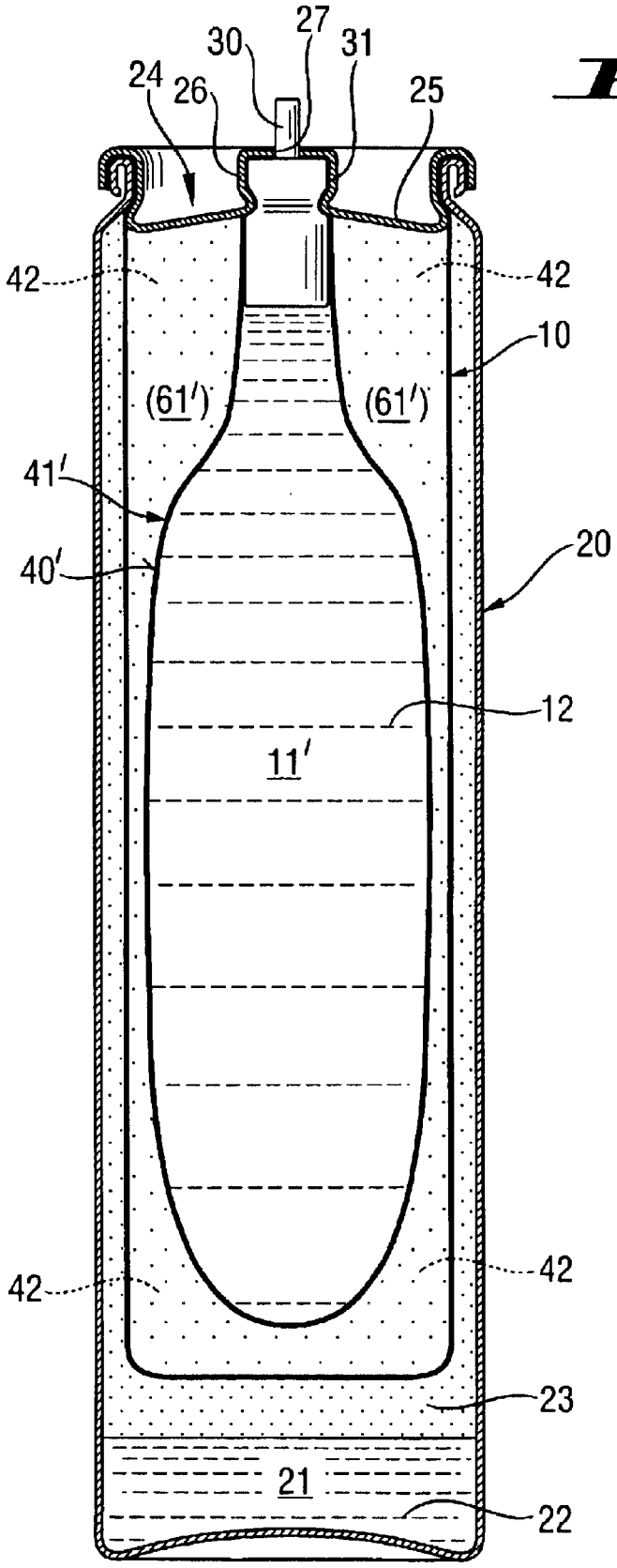
FIG. 2 diagrammatically represents a longitudinal section of a second embodiment of a pressure container according to the invention.

FIG. 2 represents a second embodiment of the pressure container according to the invention. The principle construction of this pressure container is identical to that of the above described pressure container; however, the compensation body 41' is formed with the compensation chamber 41 arranged externally around the fill material chamber 11' in the inner container 10. In this case, the fill material chamber 11' is disposed in a plastic bag 40', which assumes the function of the chamber wall between the two chambers 11' and 61'. The compensation chamber 61' in this second embodiment is filled with air and has the same function as described for FIG. 1. If the liquid fill material 12 expands due to a temperature increase, then the compressed medium or the air 42 in the compensation chamber 61' is compressed. The metallic inner container 10 is only insubstantially expanded or inwardly deformed, when the temperature again decreases.

Figure 3:
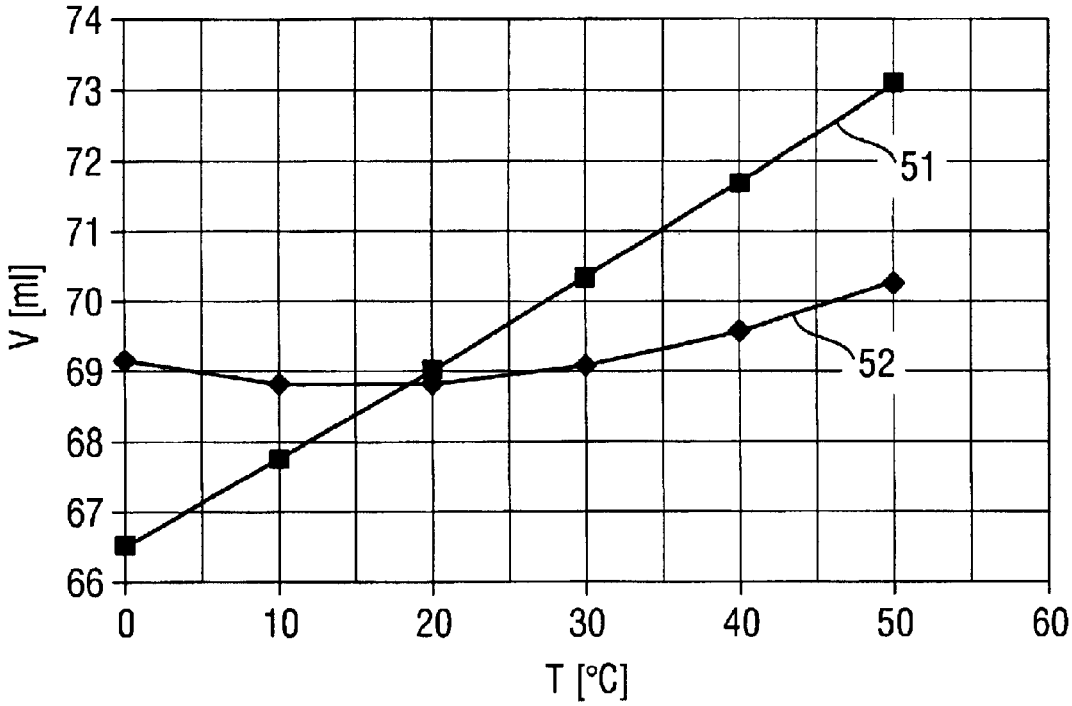
FIG. 3 is a graphic showing of the volume and temperature measurement data relative to a pressure container equipped firstly with a compensation body according to the invention then without a compensation body.

In the diagram of FIG. 3, mathematically determined data (V/T=volume/temperature) relative to the pressure container of the invention with an air-filled compensation chamber arranged freely moveably in the inner container (curve 52) in accordance with FIG. 1 and to a conventional pressure container without a compensation chamber (curve 51). As can be seen in the curves 51, 52, with a temperature variation of 10° C. to 30° C., for example, in the case of a pressure container or gas canister of the prior art without a compensation chamber, there is a volume fluctuation in the fill material chamber of approximately 3.7%. In the pressure container according to the invention equipped with an air-filled compensation body or air cushion in accordance with FIG. 1, the volume fluctuation of the fill material chamber, however, is only approximately 0.5%. The stress on the metal foil of the inner bag or the inner container is correspondingly significantly reduced.

Reference Number List

| | |
|---|---|
| 10 | Inner container |
| 11 | Fill material chamber |
| 11' | Fill material chamber |
| 12 | Fill material/liquid combustion gas |
| 20 | Outer container |
| 21 | Propellant chamber |
| 22 | Propellant, liquid phase |
| 23 | Propellant, gas phase |
| 24 | Opening |
| 25 | Cover part |
| 26 | Dome |
| 27 | Passage |
| 30 | Valve part |
| 31 | Inlet part/outlet part |
| 40 | Compensation container, chamber wall between 11 and 41 |
| 40' | Plastic bag, bag-on-valve bag, chamber wall between 11 and 41 |
| 41 | Compensation body |
| 41' | Compensation body |
| 42 | Air/compressed medium/compensation medium |
| 51 | Curve, pressure container according to the prior art, without compensation container |
| 52 | Curve, pressure container with compensation container |
| 61 | Compensation chamber |
| 61' | Compensation chamber |

What is claimed is:

1. A pressure container comprising an outer container (2) enclosing a constantly deformable or compressible inner container (10), said inner container is formed of a metal foil, said inner container (10) forms a chamber (11, 11') for fill material (12), said outer container (20) around said inner container (10) forms a chamber (21) for propellants (22, 23) which are at least one of separated fluids and/or gas-tight from one another, said outer container has a closure part (25) at one end thereof for closing said inner and outer containers (10,20) containing a valve part (30) for dispensing the fill material (12) from said fill material chamber (11, 11') in the pressure container, and a compensation body (41, 41') in said inner container (10) for compensating volume variations of said fill material chamber (11, 11').

2. A pressure container, as set forth in claim 1, wherein said compensation body (41) is a freely movable compensation container in said fill material chamber (11).

3. A pressure container, as set forth in claim 1, wherein said compensation body (41') encloses said fill material chamber (11').

4. A pressure container, as set forth in claim 1, wherein said compensation body (41, 41') contains a compensation chamber (61, 61') separated by a chamber wall (40, 40') from the fill material chamber (11, 11') and is sealed tight therefrom.

5. A pressure container, as set forth in claim 4, wherein said compensation chamber (61, 61') is filled with air (42).

* * * * *